United States Patent [19]

DeSantis

[11] 4,362,483

[45] Dec. 7, 1982

[54] HYDRAULIC SHOCK ABSORBING MECHANISM FOR THE RAM OF POWDER COMPACTING PRESSES AND THE LIKE

[75] Inventor: Raymond P. DeSantis, Troy, Mich.

[73] Assignee: PTX-Pentronix, Inc., Lincoln Park, Mich.

[21] Appl. No.: 269,512

[22] Filed: May 28, 1981

[51] Int. Cl.[3] ..... B30B 11/02

[52] U.S. Cl. ..... 425/78; 425/214; 425/412

[58] Field of Search ..... 425/78, 412, 444, 193, 425/214

[56] References Cited

U.S. PATENT DOCUMENTS

| | | | |
|---|---|---|---|
| 2,509,783 | 5/1950 | Richardson | 425/78 |
| 2,821,748 | 2/1958 | Willi | 425/78 |
| 3,191,232 | 6/1965 | Haller | 425/78 |
| 3,328,840 | 7/1967 | Vinson | 425/78 |
| 3,328,842 | 7/1967 | Vinson | 425/78 |
| 3,524,220 | 8/1970 | Davison | 425/78 |
| 3,561,056 | 2/1971 | Smith et al. | 425/78 |
| 3,657,917 | 4/1972 | Chelminski | 425/78 X |
| 3,669,582 | 6/1972 | Smith | 425/78 |
| 3,733,154 | 5/1973 | Smith et al. | 425/78 |
| 3,741,697 | 6/1973 | Smith et al. | 425/444 X |

*Primary Examiner*—J. Howard Flint, Jr.
*Attorney, Agent, or Firm*—Hauke & Patalidis

[57] ABSTRACT

An impact cushioning and shock absorbing device disposed in the coupling between the actuating member of a press ram and the ram. The device is in the form of a hydraulic piston-cylinder assembly defining a chamber which is filled with an uncompressible hydraulic fluid. The hydraulic fluid is pressurized by a compressed compressible fluid, such as air, acting on a large area piston directly coupled to a small area piston disposed in a small diameter cylinder filled with the incompressible hydraulic fluid and in communication with the chamber, the ratio in the areas of the pistons determining the pressure amplification rate or gain. When the press ram meets a resistance to its travel which is large enough to overcome the pressure of the hydraulic fluid in the chamber, the volume of the chamber is decreased with the result that hydraulic fluid is introduced in the small diameter cylinder, thus displacing the small area and the large area pistons against the pressure of the compressible fluid, and cushioning the impacts and shocks to which the ram is subjected in operation.

10 Claims, 3 Drawing Figures

HYDRAULIC SHOCK ABSORBING MECHANISM FOR THE RAM OF POWDER COMPACTING PRESSES AND THE LIKE

BACKGROUND OF THE INVENTION

In precision press operations, more particularly when articles compacted of powder material are subject to tight tolerance and high precision, dimensionally as well as in density of the compacted articles, it is advantageous to provide some mechanism for relieving the initial press force by which the compacting is accomplished and for cushioning the impact shocks. Various types of deflection compensation systems and impact shock cushioning devices have been proposed in the past, such as disclosed in U.S. Pat. No. 3,733,154, assigned to the same assignee as the present invention, which discloses an impact shock or absorbing system forming part of the press ram itself. Deflection compensation and shock absorbing mechanisms may also be incorporated into the die and punch assembly, as disclosed, for example, in U.S. Pat. No. 3,669,582, also assigned to the same assignee as the present application.

SUMMARY OF THE INVENTION

In addition, it is often desirable to effectuate a pressing operation at a predetermined ram pressure or at ram pressure within a predetermined range of pressures. Such a requirement is difficult to achieve in a mechanical press.

The present invention provides an impact cushioning and shock absorbing mechanism and a ram pressure adjusting device, more particularly for the ram of a powder compacting press, which requires no modification to the ram itself or to the punch and die assembly used for forming workpieces. The invention provides an impact cushioning, shock absorbing and pressure adjusting mechanism forming part of the coupling member between the ram of a press and the actuating member for reciprocating the ram, and the invention may thus be incorporated as part of the press mechanism during manufacture or installed in retrofitting already existing presses presently in operation.

The diverse objects and advantages of the present invention will become apparent to those skilled in the art when the following description of the best mode contemplated for practicing the invention is read in conjunction with the accompanying drawing wherein:

DETAILED DESCRIPTION OF THE PREFERRED EMBODIMENT

Figure 1:
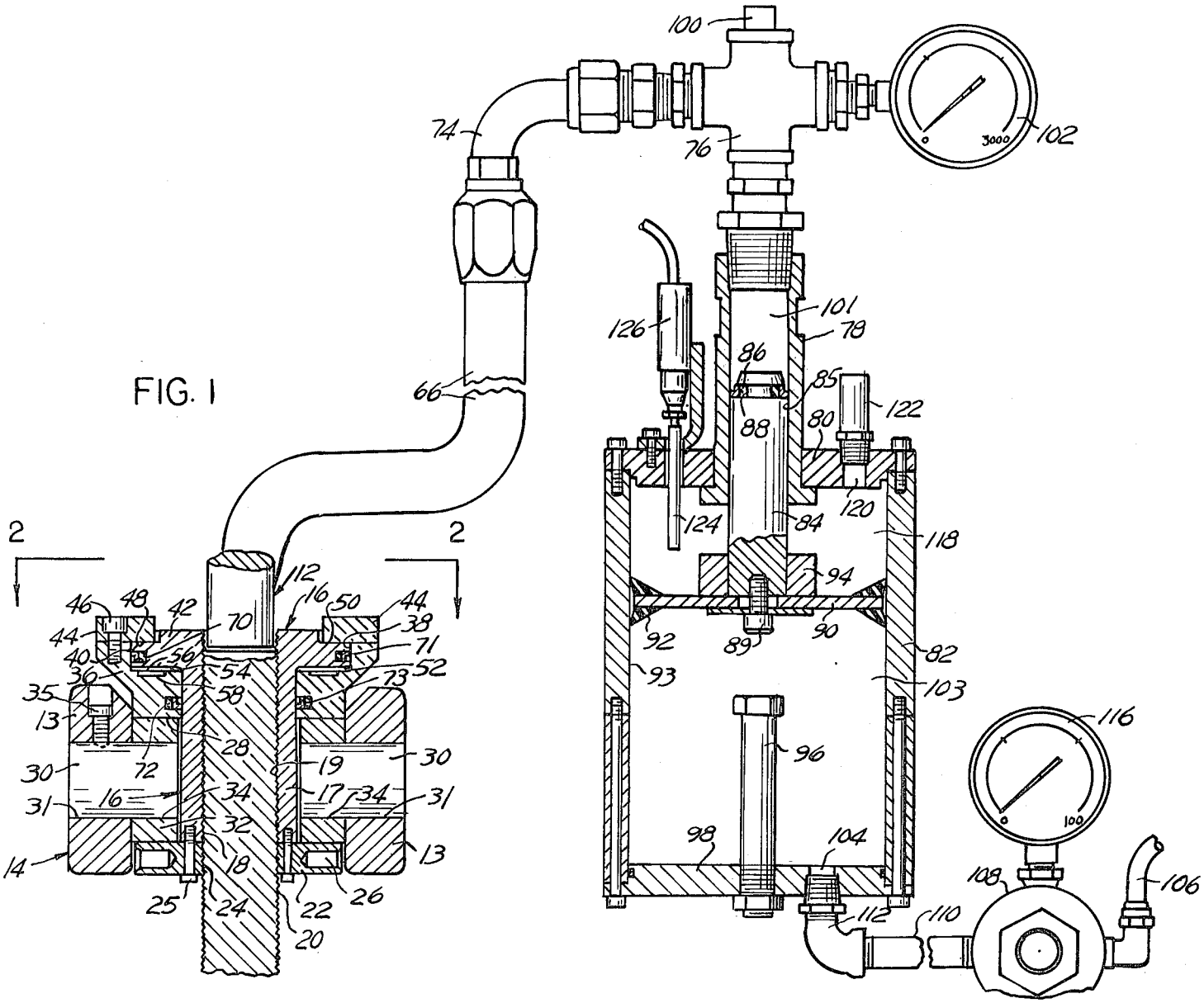
FIG. 1 illustrates, with some portions omitted and others broken away, an example of structure for impact cushioning and shock absorbing means for the ram of a press such as a treadle-actuated ram for powder compacting press.
Figure 2:
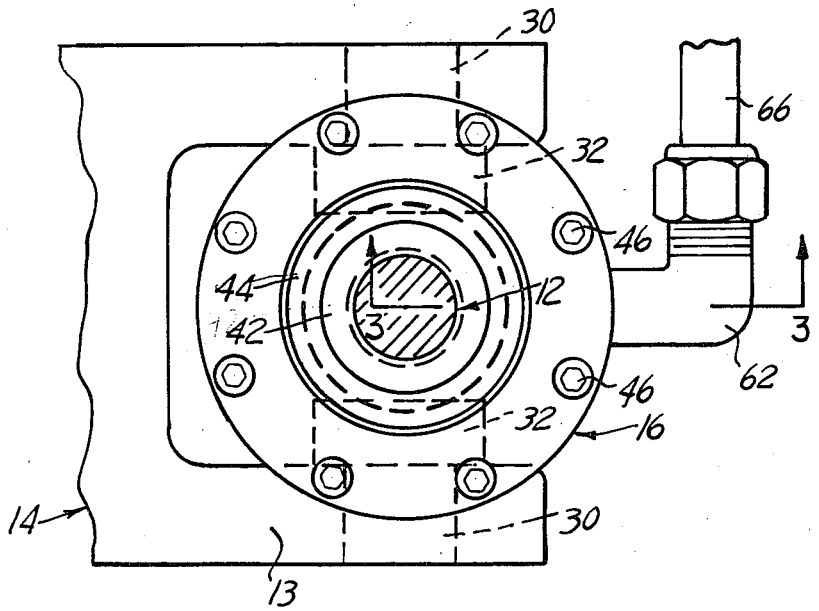
FIG. 2 is a partial top plan view from line 2—2 of FIG. 1.

In U.S. Pat. Nos. 3,328,840, 3,328,842, 3,415,142, 3,561,056 and 3,741,697, for example, there are disclosed powder compacting presses having a ram, such as ram 12 as illustrated in the drawing, reciprocated as a result of being driven by the bifurcated end 13 of a rocker arm or treadle 14 through the intermediary of a spool 16. The ram 12 is supported for reciprocation below the table of the press, not shown, and punch holding means, not shown, are mounted on the end of the ram 12 for reciprocating the punch or punches of a punch and die assembly mounted in an aperture in the table.

The spool 16 has a body 17 having a longitudinal bore 18 provided with an internal thread 19 engaging a corresponding peripheral threaded portion 20 of the ram 12. The spool 16 has a lower radially extending flange formed by a disk-like plate 22, also provided with an internally threaded bore 24 mounted on the lower end of the spool body 17, appropriate screws or bolts 25 fastening the disk-plate 22 to the end of the spool body 17. Radial bores are disposed in the flange plate 22, as shown at 26 at FIG. 1, such that by means of a spanner or a rod introduced through a bore 26, the flange plate 22 and the spool body 17 are rotated in unison to adjust the relative position of the spool 16 along the longitudinal axis of the ram 12. As is well known in the art, the upper limit of the adjustment of the spool 16 along the longitudinal axis of the ram 12 determine the press dwell position of the compacting punches.

The force of compaction is transmitted through the ram 12 to the article to be compacted by the oscillating bifurcated end 13 of the treadle 14 via an upper annular abutment 28 of the spool 16. In prior art structures as disclosed in the aforesaid patents, the annular abutment 28 is on a flange which is an integral part of the spool 16, and the force of compaction is transmitted to the spool 16 through the intermediary of a pair of pins 30 mounted in aligned bores 31 in the bifurcated end 13 of the treadle 14 and of a pair of substantially rectangular pillar blocks 32, each having a central bore 34 through which is disposed the end of each pin 30. Set screws, such as set screws 35, hold each pin 30 fast in each bore 31.

Figure 3:
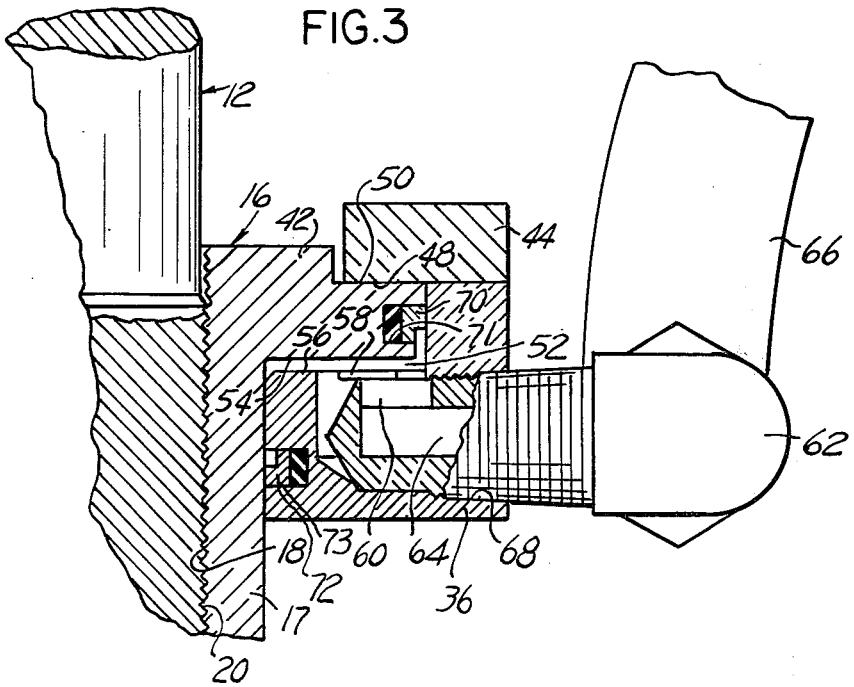
FIG. 3 is a partial sectional view from line 3—3 of FIG. 2.

In the structure illustrated in the drawing however, the annular abutment surface 28 is formed at the bottom of a ring or sleeve 36 slidably disposed around the periphery of the body 17 of the spool 16. The sleeve 36 has an enlarged diameter bore 38 slidably accepting the edge portion 40 of a flange 42 integrally formed on the end of the spool body 17. The permissible displacement of the sleeve 36 relative to the flange 42 of the spool body 17 is limited in one direction by a ring 44, fastened to the top of the sleeve 36 by means such as bolts or screws 46, as a result of the engagement of an annular abutment surface 48 on the ring 44 with a corresponding annular abutment surface 50 on the top of the spool flange 42. When the two annular surfaces 48 and 50 abut, a variable volume changer in the form of an annular chamber 52 is formed between the lower annular surface 54 of the spool flange 42 and an annular surface 56 disposed at the bottom of the enlarged diameter bore 38 in the sleeve 36. The annular chamber 52 is placed in fluid communication, by means of an annular groove 58 formed in the annular surface 56 with a passageway 60, FIG. 3, transversely disposed at the end of a fitting 62 and leading into a channel 64 in the fitting 62 mounted on the end of a flexible hose 66. The fitting 62 is fitted into a radial threaded aperture 68 in the sleeve 36. Seals in the form of annular rings 70 and 72 are disposed in appropriate grooves 71 and 73 respectively in the edge 40 of the spool flange 42 and in the inner surface of the sleeve 36 engaged with the peripheral surface of the spool body 17 to prevent flow of fluid from the annular chamber 52, except through the fitting 62 and hose 66, when the volume of the annular chamber 52 is reduced as a result of the sleeve 36 being displaced relative to the spool flange 42 in the direction that disengages the annular abutment surfaces 48 and 50 from each other.

The flexible hose 66 is connected through an elbow 74, FIG. 1, and a T-connector 76, for example, to a relatively small bore cylinder 78 fastened in the end wall 80 of a much larger bore cylinder 82. A piston rod 84 is mounted reciprocable in the bore 85 of the cylinder 78, the end of the piston rod 84 being provided with an appropriate sealing ring 86 fitted in a receiving groove 88. The other end of the piston rod 84 is fastened, such as by a bolt 89, to a relatively large piston 90, provided with peripheral elastomeric piston cup 92, disposed reciprocable in the relatively large bore 93 of cylinder 82. The upward displacement of the piston 90 is limited by a ring 94 disposed around the piston rod 84 at its junction with the piston 90, and the permissible travel of the piston 90, in a downward direction, is limited by an axially fastened stud or bolt 96 projecting in the interior of the cylinder 82 from the other end wall 98 of the cylinder.

The T-connector 76, which is the highest point of the system, is provided with a plug 100 closing the top of the T-connector such that, after removal of the plug 100, the chamber 101 defined in the bore 85 of the cylinder 78 above the end of the piston rod 84 and the whole system including the annular chamber 52, and the flexible hose 66, may be filled with an uncompressible hydraulic fluid such as oil. The pressure of the hydraulic fluid in the system is visually displayed by a pressure gauge 102.

Compressed air may be introduced into a chamber 103 in the bore 93 of the cylinder 82 below the piston 90 through a port 104 in the cylinder end wall 98. Compressed air is obtained from an air compressor or other compressed air source, not shown, through a line 106, a pressure regulator 108 and a line 110 connected to a fitting 112 providing air to the chamber 103 through the port 104. A pressure gauge 116 displays the pressure of the air being supplied to the chamber 103, as adjusted by means of the reguator 108. In view of the difference in areas between the piston 90 and the piston rod 84, the assembly of the piston 90 and piston rod 84 displaceable in the cylinder 82 and the cylinder 78 acts as a pressure amplifier between the air contained in the chamber 103 and the oil contained in the chamber 101 above the piston rod 84, the gain or amplification factor of the pressure amplifier being proportional to the ratio of the surface area of the piston 90 to the surface area of the piston formed at the end of the rod 84. Atmospheric air present in the chamber 118 formed on the top of the piston 90 between the piston and the end wall 80 of the cylinder 82 is exhausted to the ambient through a port 120 provided with a muffler 122. In the event of complete loss of pressure of the fluid in the hydraulic fluid portion of the system, the piston 90 is caused by the air pressure in the chamber 103 to be displaced upwardly until the upper surface of the piston engages the end of a plunger 124 tripping a safety electric limit switch 126 from "on" to "off". The limit switch 126, when turned off, in turn turns off the relay of the press motor, such as to immediately stop the operation of the press.

In operation, compressed air at a predetermined pressure is supplied to the chamber 103 in the bore 93 of the cylinder 82 below the piston 90. The incompressible hydraulic fluid, such as oil, filling the annular chamber 52 holds apart the annular surface 56 of the sleeve 36 and the annular surface 54 of the spool flange 42, the annular surfaces 48 and 50 being in engagement with each other as illustrated in the drawing. At the end of a compaction cycle, that is at the end of the upper stroke of the ram 12 as actuated by the treadle 14 through the sleeve 36, if the pressure applied to the article being compacted exceeds the force exerted on the spool 16 by the pressure of the oil in the annular chamber 52, oil is expelled from the annular chamber 52, thus displacing the piston rod 84 downwardly against the air pressure in the chamber 103 below the piston 90. The system, therefore, acts as a cushion which dampens mechanical shocks, and by correct adjustment of the pressure of the compressible fluid, such as compressed air, in the system the pressure exerted by the punches on the article being compacted may be precisely determined as a function of the pressure in the system, rather than as a function of the dwell position of mechanical parts having solid surfaces in engagement.

A particular advantage of the invention which will be readily apparent to those skilled in the art is that the invention permits to effectuate compaction of articles repetitively at a constant predetermined ram pressure. For that purpose, the chamber 103 in the bore 93 of the cylinder 82 below the piston 90 is filled with compressed air at a predetermined pressure, as controlled by the setting of the pressure regulator 108. The regulator 108 is set such as to maintain the pressure in the chamber 103 constant, with the result that the pressure of the hydraulic fluid in the chamber 101 above the piston rod 84 and in the variable volume annular chamber 52 is maintained at a constant value. The stroke of the ram 12 is adjusted such that when the ram 12 dwells at the end of its compacting stroke the annular flange 42 of the spool 16 is caused to be displaced relatively to the sleeve 36 from the position illustrated at FIG. 1 to any intermediary position short of causing engagement of the annular surface 54 with the annular surface 56. This in turn causes a reduction of the volume of the variable volume annular chamber 52, thus pumping a portion of the incompressible hydraulic fluid contained in the chamber 52 into the high pressure hydraulic system. As the pressure of the hydraulic system remains constant, pressing of the compacted article is effected at constant pressure.

If it is desired to compact articles at a pressure within a predetermined range, the air pressure regulator 108 is adjusted such that after compressed air at a predetermined pressure has been introduced in the chamber 103, backflow of compressed air through the pressure regulator is prevented even though the pressure of the air in the chamber 103 may have been increased. Under those conditions when, during dwell of the ram 12 at the end of its pressing stroke, the volume of the annular chamber 52 is momentarily decreased, the downward displacement of the piston 90 in the cylinder 82 causes an increase of pressure of the compressed air in the chamber 103 below the piston, and consequently an increase of the pressure in the high pressure hydraulic portion of the system.

If the resisting force to which the ram 12 is subjected exceeds the force provided by the pressurized fluid contained in the annular chamber 52, the spool annular flange 42 is caused to be displaced relative to the sleeve 36, until the annular surfaces 54 and 56 engage each other. Under those conditions, the ram function is exactly the same as it would be, except for a slight lost motion, in a mechanical press without the benefit of the improvement of the invention.

It will be appreciated by those skilled in the art that structures other than the one described hereinbefore in detail may be used for providing a variable volume chamber interposed between a press ram and the ram actuating mechanism, such as a chamber having deformable end diaphragms or a chamber in the form of an expandable bag, for example.

Having thus described the invention by way of an example of structure thereof, modifications whereof will be apparent to those skilled in the art, what is claimed as new is as follows:

1. In a press apparatus having a reciprocable ram, means for reciprocating said ram and means coupling said reciprocating means to said ram, an impact cushioning and shock absorbing device for said coupling means comprising a first intermediary member attached to said ram, a second intermediary member displaceable relative to said first intermediary member, a pair of abutment means each on one of said intermediary members limiting the travel of said first intermediary member away from said second intermediary member, means connecting said reciprocating means to said second intermediary member, a variable volume chamber between said intermediary members, means for introducing a non-compressible fluid in said variable volume chamber for normally holding said intermediary members away from each other and for holding said abutment means in engagement with each other, and means connected to said introducing means for pressurizing said noncompressible fluid, said pressurizing means comprising a first cylinder, a first piston reciprocably disposed in said first cylinder, means for introducing a compressible fluid on one side of said first piston, a rod attached to said first piston and reciprocable thereby, a second cylinder, a second piston disposed on the end of said rod and reciprocable in said second cylinder for pressurizing said noncompressible fluid in said second cylinder, wherein said first piston has an area relatively larger than the area of said second piston for transmitting the pressure of said compressible fluid to said noncompressible fluid with an amplification which is proportional to the ratio of the areas of the pistons.

2. The device of claim 1 wherein said variable volume chamber is defined by said intermediary members forming a piston-cylinder arrangement.

3. The device of claim 1 further comprising limit switch means tripped by said first piston upon travel beyond a limit, sid limit switch being arranged to interrupt the operation of said press apparatus.

4. The device of claim 2 wherein said reciprocating means comprises the bifurcated end of a power driven oscillating treadle and said coupling means comprises a spool member threadably mounted around said ram, said spool member having an annular flange defining said first intermediary member, a sleeve member disposed around said spool member and defining said second intermediary member, said sleeve member having a bore accepting said flange, said flange forming said piston and said sleeve member forming said cylinder of said piston-cylinder arrangement.

5. The device of claim 4 wherein said abutment means comprises a ring fastened to said sleeve member and an annular surface on said flange engageable with said ring.

6. The device of claim 5 further comprising means limiting the displacement of said first piston in at least one direction.

7. The device of claim 6 comprising means limiting the displacement of said first piston in both directions.

8. The device of claim 7 wherein said second piston is said rod.

9. The device of claim 1 wherein the pressure of said compressible fluid is maintained constant.

10. The device of claim 1 wherein the pressure of said compressible fluid is maintained within a defined range.

* * * * *